US008789347B2

(12) United States Patent
Bogle et al.

(10) Patent No.: US 8,789,347 B2
(45) Date of Patent: Jul. 29, 2014

(54) APPARATUS AND METHOD FOR CAPPING AND SEALING PHARMACEUTICAL VIALS

(75) Inventors: F. William Bogle, Malvern, PA (US); Richard Spencer, Spring City, PA (US)

(73) Assignee: Genesis Packaging Technologies, Exton, PA (US)

( * ) Notice: Subject to any disclaimer, the term of this patent is extended or adjusted under 35 U.S.C. 154(b) by 0 days.

(21) Appl. No.: 13/611,657

(22) Filed: Sep. 12, 2012

(65) Prior Publication Data

US 2014/0069062 A1 Mar. 13, 2014

(51) Int. Cl.
*B67B 1/04* (2006.01)
*B65B 7/28* (2006.01)

(52) U.S. Cl.
USPC ..... 53/489; 53/329; 53/331

(58) Field of Classification Search
CPC ..... B65B 7/28; B65B 7/2821; B65B 7/2842; B67B 3/00; B67B 3/261; B67B 3/285; B67B 1/04
USPC ..... 53/489, 329, 331
See application file for complete search history.

(56) References Cited

U.S. PATENT DOCUMENTS

| | | | | |
|---|---|---|---|---|
| 3,577,701 | A | 5/1971 | Bott et al. | |
| 3,964,234 | A * | 6/1976 | Hurst | 53/77 |
| 3,998,032 | A * | 12/1976 | Koebbeman | 53/352 |
| 4,219,986 | A * | 9/1980 | Osterhaus | 53/314 |
| 4,435,942 | A * | 3/1984 | Zaltsman | 53/489 |
| 4,511,044 | A * | 4/1985 | Connor et al. | 209/522 |
| 4,552,278 | A * | 11/1985 | Romanauskas | 215/277 |
| 4,614,077 | A * | 9/1986 | Muto et al. | 53/490 |
| 6,158,196 | A * | 12/2000 | Trebbi et al. | 53/331.5 |
| 6,857,250 | B1 * | 2/2005 | Taylor | 53/331 |
| 6,874,301 | B2 * | 4/2005 | Kitamoto | 53/490 |
| 7,024,837 | B2 * | 4/2006 | Takebe et al. | 53/490 |
| 7,204,151 | B2 * | 4/2007 | Kitamoto et al. | 73/761 |
| 8,353,145 | B2 * | 1/2013 | Zanini et al. | 53/302 |
| 8,656,688 | B2 * | 2/2014 | Schonfelder et al. | 53/329 |
| 2005/0022479 | A1 * | 2/2005 | Kitamoto | 53/490 |
| 2005/0257623 | A1 | 11/2005 | Kitamoto et al. | |

OTHER PUBLICATIONS

International Search Report for PCT/US2013/058933 mailed Dec. 20, 2013.

* cited by examiner

*Primary Examiner* — Hemant M Desai
*Assistant Examiner* — Gloria R Weeks
(74) *Attorney, Agent, or Firm* — Caesar, Rivise, Bernstein, Cohen & Pokotilow, Ltd.

(57) ABSTRACT

An apparatus and a method for capping and sealing a vial with a cap assembly including a deformable annular seal, e.g., a ferrule, is disclosed. The apparatus comprises a base for holding the vial, a pressure applying platen, plural sealing rollers and associated electronic circuitry and motors. The platen is arranged to be moved relative to the base, whereupon it engages and applies a force to the cap assembly. The load cell measures the force applied and provides a signal indicative thereof to the electronic circuitry. The electronic circuitry determines when a desired amount of force has been applied to control the operation of the rollers, whereupon the rollers apply a force to the annular seal to permanently crimp the annular seal on the vial.

10 Claims, 3 Drawing Sheets

APPARATUS AND METHOD FOR CAPPING AND SEALING PHARMACEUTICAL VIALS

FIELD OF THE INVENTION

This invention relates generally to capping and sealing apparatus and methods for capping and sealing hollow vessels and more particularly to apparatus and methods for capping and sealing vials, such as pharmaceutical vials.

BACKGROUND OF THE INVENTION

For more than sixty years injectable drugs have been packed in glass vials. Such vials typically are formed of glass and have a cylindrical neck terminating in a flanged top or lip, with the opening to the interior of the vial extending through the neck. The neck is sealed by means of a rubber stopper and an aluminum seal or ferrule. The technique used to seal such a vial typically entails moving the vial so that it is compressed between a bottom base and a pressure block or platen. When the vial is compressed in place, a roller or rollers contact the aluminum ferrule below the neck of the vial and force the metal in place permanently, thereby holding the stopper in place and sealing the vial. In short, the usual method for achieving compression of the elastomeric element or stopper is mechanical and dimensionally driven. In particular, the vial is raised a certain distance into the pressure block or platen to apply pressure to the cap assembly. Using this technique, the variations of vial height within the tolerance range of the vial manufacture influence the amount compression achieved, so that some vials may not be adequately capped and sealed.

Accordingly, a need exists for a capping and sealing apparatus which overcomes the drawbacks of the mechanical/dimensional driving of the prior art capping sealing apparatus. The subject invention addresses that need.

SUMMARY OF THE INVENTION

In accordance with one aspect of the invention there is provided apparatus for capping and sealing a vial with a cap. The vial comprises a hollow body having an opening to the interior thereof and a flanged neck surrounding the opening. The flanged neck of the vial has an undersurface. The cap comprises an elastomeric stopper arranged for disposition within the opening in the vial and an annular seal arranged to be crimped around and tightly engage the flanged neck of the vial to hold the stopper in place. The apparatus comprises a platen, a base, a load cell and at least one roller. The base is arranged to receive the vial thereon with the vial oriented so that the neck of the vial confronts the platen. At least one of the base and the platen are arranged to be moved relative to the other (e.g., the base moved toward the platen) after the stopper is located in the opening of the vial, whereupon the platen engages and applies a force to the stopper to drive the stopper into the opening of the vial. The load cell is arranged to ensure that the platen and the base are moved relative to each other to provide a desired amount of force to the stopper to cause the stopper to be firmly seated within the opening in the vial. The at least one roller is arranged to apply a force to the annular seal to crimp the annular seal on the neck of the vial to hold the stopper in place within the opening in the vial and thereby seal the vial.

Another aspect of this invention entails a method of capping and sealing a vial with a cap. The vial comprises a hollow body having an opening to the interior thereof and a flanged neck surrounding the opening, the flanged neck has an undersurface. The cap comprises an elastomeric stopper and an annular seal arranged to be crimped around and tightly engage the flanged neck of the vial to hold the stopper in place. The method basically comprises disposing the vial on a base and under a platen so that the neck of said vial confronts the platen. The stopper is disposed in the opening in the vial with the annular seal disposed about the stopper and the neck of the vial. At least one of the base and the platen are moved with respect to the other so that the platen applies a force to the stopper to drive the stopper into the opening in the vial. The load cell is utilized to ensure that the platen and the base are moved with respect to each other to provide a desired amount of force to the stopper to cause the stopper to be firmly seated within the opening in the vial. A force is applied to the annular seal to crimp the annular seal on the neck of the vial to hold the stopper in place within the opening in the vial and thereby seal the vial.

DETAILED DESCRIPTION OF THE PREFERRED EMBODIMENT

Figure 1:
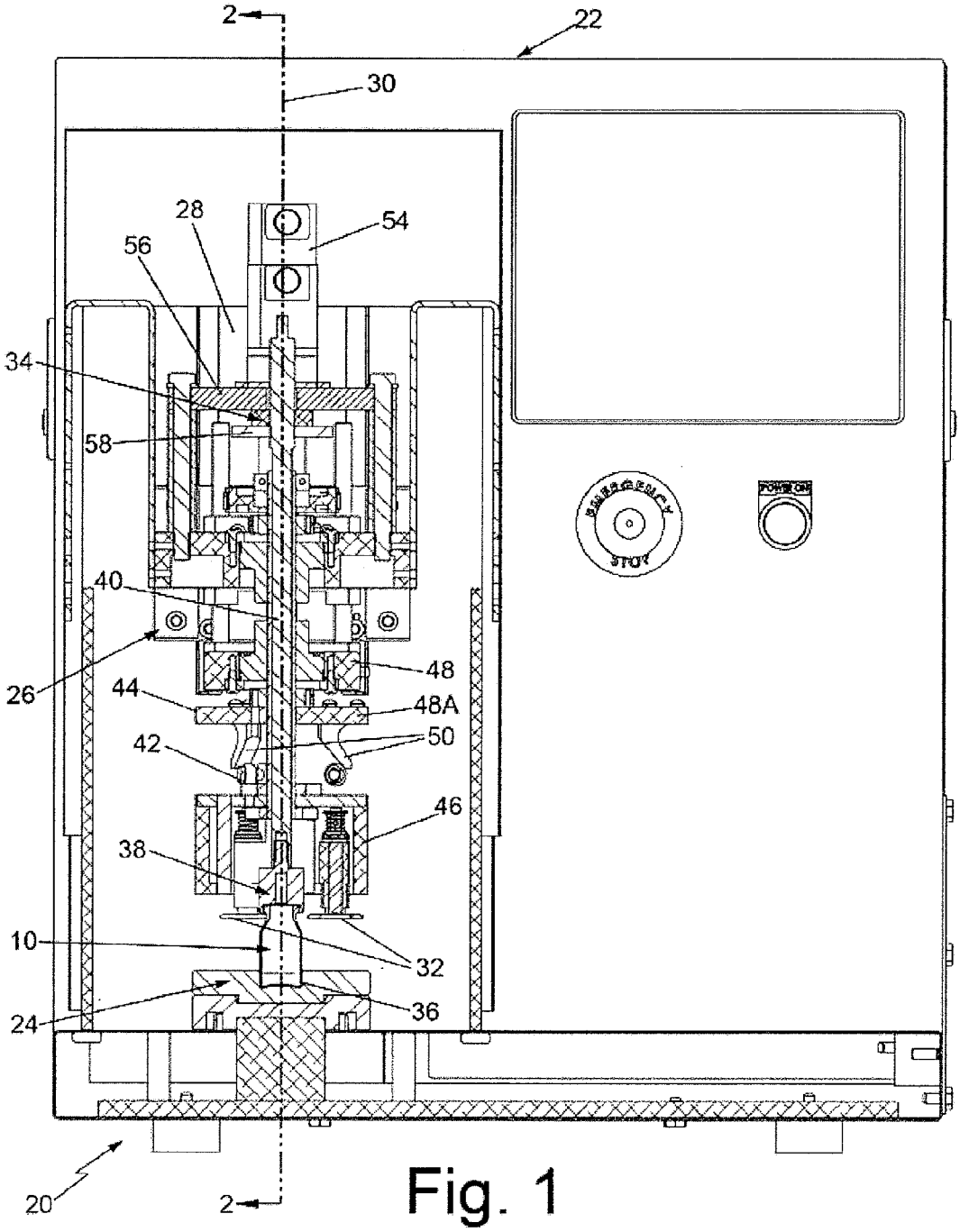
FIG. 1 is a front elevation view of a portion of one exemplary embodiment of apparatus for capping and sealing pharmaceutical vials constructed in accordance with the subject invention.

Referring now to the various figures of the drawing wherein like reference characters refer to like parts, there is shown in FIG. 1 one exemplary embodiment of a apparatus 20 constructed in accordance with one aspect of this invention for capping and sealing vials. The apparatus 20 is particularly suitable for capping and sealing pharmaceutical vials, such as a glass vial 10, used for injectable drugs, but can also be used on vials made of plastic.

Before describing the details of the apparatus 20 a brief description of the vial 10 is in order. To that end the vial basically comprises a hollow body formed of glass or plastic in which a pharmaceutical or other drug or other product is disposed. The entrance to the interior of the vial's body is provided via an opening extending through the neck of the vial. The top of the neck of the vial is in the form of a lip or flange having a generally planar top surface and a somewhat undercut surface. The interior surface of the opening in the neck of the vial may include a blow-back annular recess, if desired. The vial is arranged to be sealed by a cap assembly. The cap assembly basically comprises a rubber or other elastomeric stopper and an annular sealing ring or ferrule. The stopper is arranged to be inserted within the opening in the neck of the vial. The ferrule is an annular member made of any suitable material, e.g., aluminum, and which is arranged to be crimped or otherwise deformed into place about the flange of the vial's neck to hold the stopper in place. If desired the cap assembly may include a centrally located tamper evident disc disposed over the stopper and within the ferrule.

The apparatus 20 for sealing a vial 10 basically comprises a housing 22 enclosing the mechanical and electrical/electronic components of the apparatus. The mechanical components of the apparatus basically comprise a base 24 upon which the vial 10 with a cap assembly located thereon is disposed and a movable sealing head assembly 26 disposed above the base 24. The sealing head assembly is mounted on a carriage 28 and is arranged to be brought downward toward the base to apply a desired force to the cap assembly so that the ferrule of the cap assembly can be crimped in place to complete the sealing of the vial. The sealing head assembly has a central longitudinal axis 30 (FIG. 1) which is coaxial with the central longitudinal axis of the vial and includes a plurality of spring-biased rollers 32, to be described later, disposed equidistantly about that axis. The rollers are arranged to be brought radially inward so that each roller engages a respective portion of the periphery of the ferrule that is disposed under the vial's flange. When this occurs the sealing head itself is rotated about the central longitudinal axis to cause the rollers to move in a planetary-like motion about the axis whereupon each roller rolls along the periphery of the ferrule to crimp the ferrule into place on the vial. It should be noted at this juncture, that while the exemplary apparatus includes plural sealing rollers, the apparatus can be configured to make use of only a single sealing roller. In fact, apparatus can be constructed in accordance with this invention to make use of mechanisms other than sealing rollers to crimp the ferrule in place once a desired amount of force has been applied to the cap assembly.

To that end, in accordance with a basic aspect of this invention, the sealing head carriage 28 includes a load cell 34 to determine when the desired amount of force has been applied to the cap assembly so that the ferrule can be crimped in place. The load cell is located in upper portion of the sealing head carriage and is arranged to provide a signal to electronic circuitry (not shown) within the housing. That circuitry not only determines when the desired amount of force has been applied to the cap assembly but also controls the operation of the apparatus to seal the cap assembly in place on the vial once that desired amount of force has been applied. To that end, as will be seen later, the electronic circuitry in the housing serves to provide appropriate electrical control signals to the various motors and other components to effect the sealing operation.

Before describing the sealing head 26 and its operation, a brief discussion of the construction of the base 24 is in order. The base may be configured to accept a single vial, such as shown in FIG. 1, to cap and seal that vial, or may be arranged for holding a plurality of vials wherein the vials are sequentially indexed or otherwise conveyed to a position under the sealing head, whereupon each vial is sealed. In the exemplary embodiment shown the base 24 is arranged to hold a single vial, which is hand-loaded into the apparatus 20 for capping and sealing. In particular, the base is in the form of a puck-like member having a recess 36 in its top surface for receipt of the bottom of the vial 10. At the time that the vial is disposed within the recess 28 in the base it will have been filled with its contents, e.g., a pharmaceutical, and the cap assembly placed thereon. In particular, the stopper of the cap assembly will have been disposed within the opening of the vial's neck, with the ferrule extending about the vial's flange and with the bottom of the ferrule disposed under the flange.

The sealing head 26 basically comprises a pressure block or platen 38, a pressure shaft 40, the heretofore identified load cell 34, a roller assembly 42, and a cam assembly 44, all of which are mounted on the sealing head carriage 28. The roller assembly 42 includes the heretofore identified spring biased rollers 32, which are located within a body 46 and equidistantly spaced about the central longitudinal axis 30. The rollers are coupled to the cam assembly 44. The cam assembly 44 basically comprises a cam actuator plate 48 and a cam plate 48A. A plurality of cams 50 extend downward from the cam plate 48A. The cams 50 are arranged to engage portions of the body 46 to move the rollers inward radially towards the axis 30 when the cam plate 48A is moved downward by the cam actuator plate 48. The cam actuator plate 48 is arranged to be moved downward by a cam actuator 52 under the force provided by a cam actuator servo motor 54.

The platen 38 is arranged to engage the top of the cap assembly with a desired amount of force on the stopper and ferrule to properly seat the stopper in the opening in the neck of the vial. The platen basically comprises a cylindrical member mounted on the lower end of a pressure shaft 40. The bottom surface of the platen 38 includes a central recess arranged to receive the cap assembly. The pressure shaft 40 is a threaded rod-like member which is mounted on the sealing head carriage 28. The upper end of the pressure shaft extends through an opening in a load cell bridge 56 and is movable with respect thereto. The load cell bridge 56 is a disk-like member which is fixedly mounted on the sealing head carriage 28 and is movable with it. The sealing head carriage also includes a load cell clamping plate 58 which is fixedly secured onto the pressure shaft 40 below the load cell bridge 56. The load cell clamping plate 58 includes a threaded opening through which a portion of the threaded pressure rod 40 extends. Thus, the load cell clamping plate is secured to the pressure rod and movable with it. The position of the load cell clamping plate with respect to the pressure rod can, however, be adjusted since the connection between those members is their mating threads.

The load cell 34 is also mounted on the sealing head carriage 28 and is located between the load cell bridge 56 and the load cell clamping plate 58, with a portion of the pressure rod 40 extending through a central opening in the load cell. The load cell can be of any type, e.g., strain gauge, hydraulic, hydrostatic, capacitive, piezoelectric, etc. In one exemplary embodiment it comprises a quartz sensor load cell such as the Load Washer Type 9101 available from the Kistler Group of Switzerland and having a range of 0-20 kilonewtons.

The roller assembly 42 is arranged to be spun about the central longitudinal axis 30 so that each of the rollers 32 is carried about that axis in a planetary motion. To that end, a motor 60 is mounted on the sealing head carriage and is coupled to the roller assembly by a drive belt 62. Operation of the motor, which is under the control of the electronics of the apparatus 20, causes the drive belt to rotate, whereupon the roller assembly is rotated about axis 30.

Figure 2:
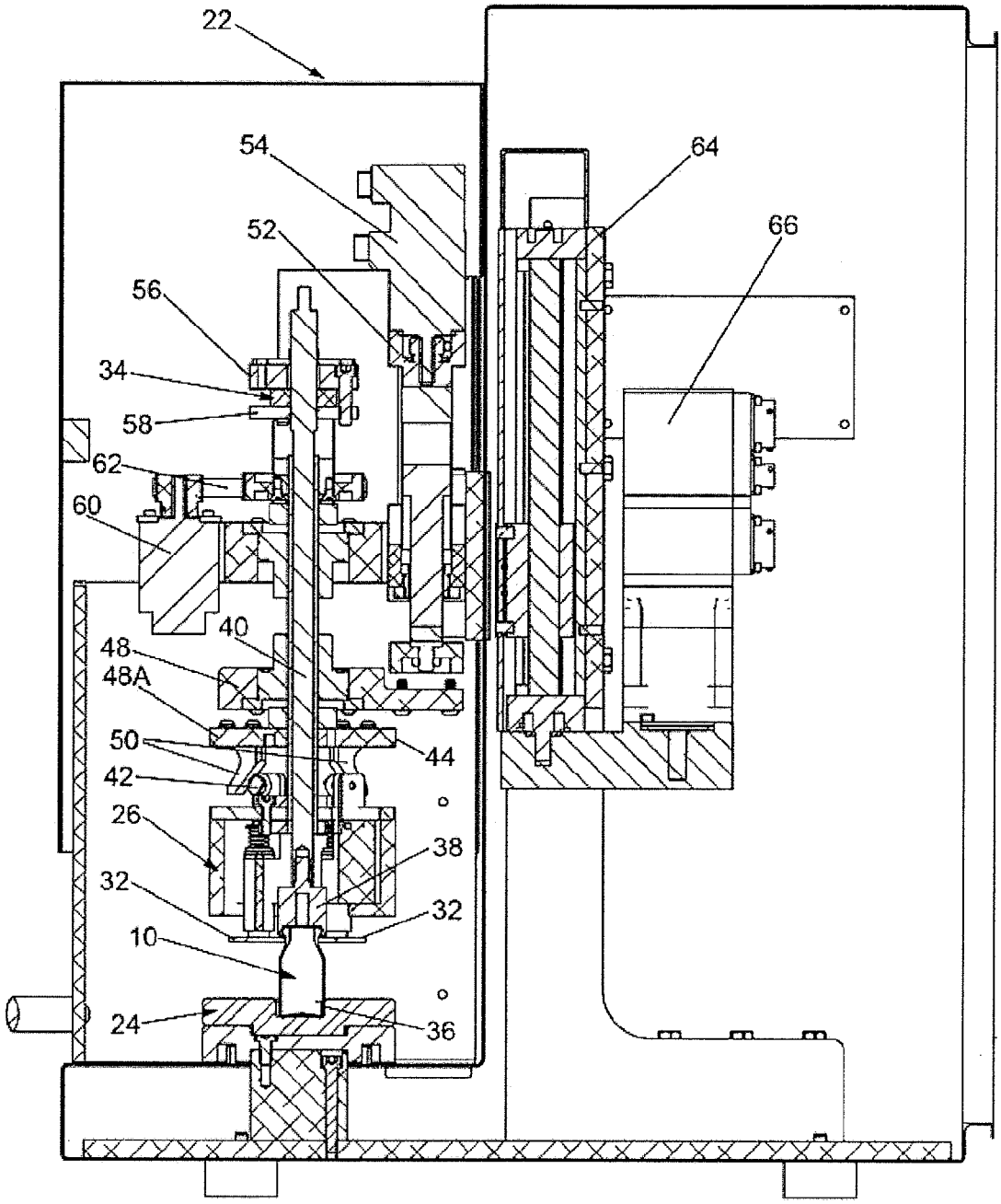
FIG. 2 is a sectional view taken along line 2-2 of FIG. 1.
Figure 3:
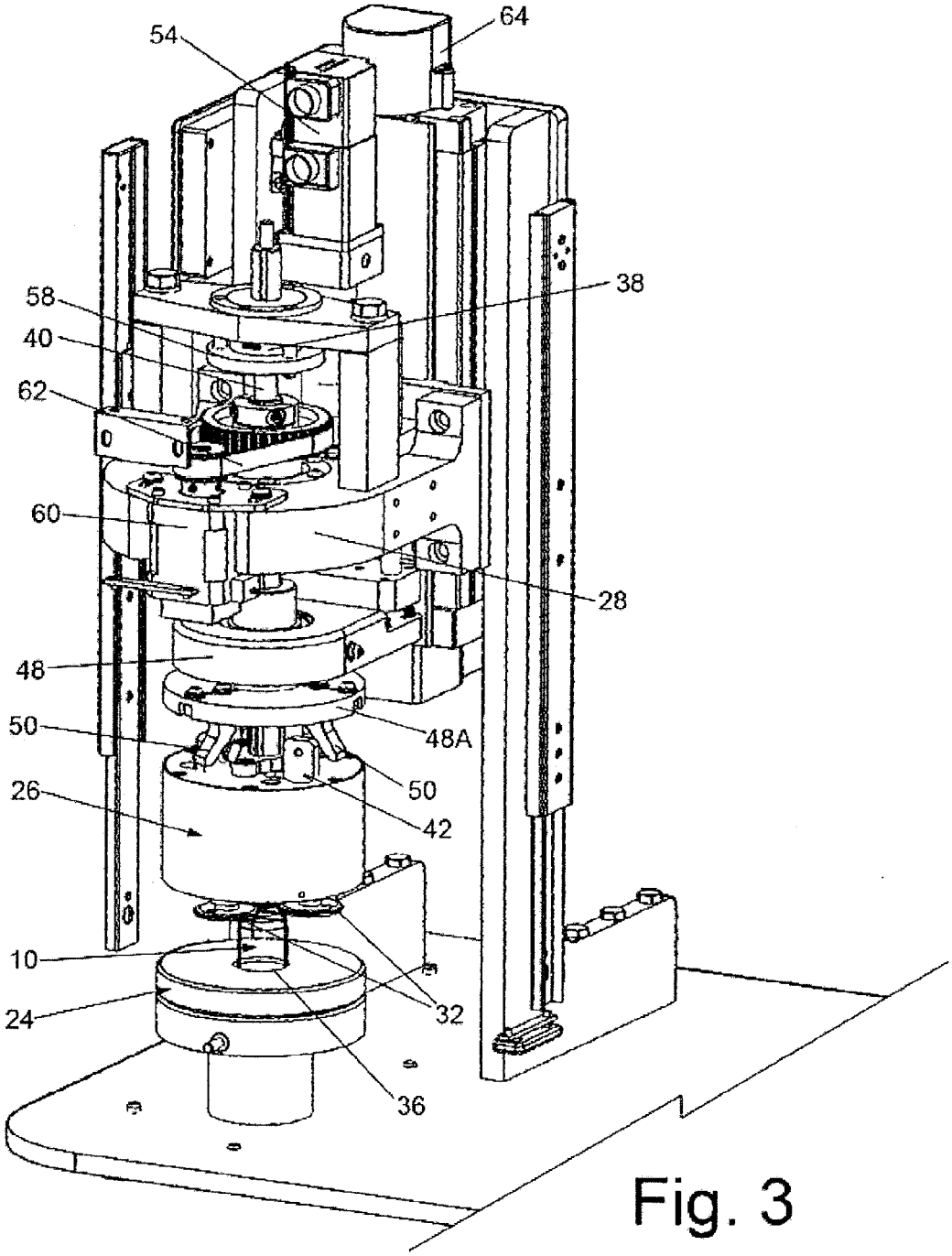
FIG. 3 is an isometric view of a portion of the apparatus shown in FIGS. 1 and 2.

The sealing head carriage 28 is arranged to be moved downward toward the vial 10 by a sealing head carriage actuator 64 (FIG. 2) under the drive provided by an associated sealing head carriage actuator servo motor 66. The movement of the sealing head carriage 28 downward causes the platen 38 located on the lower end of the pressure rod 40 to engage the cap assembly on the vial. Continued downward movement of the carriage 28 applies a force on the cap assembly. The contact of the platen 38 on the cap assembly resists further downward movement of the pressure rod 40 as the carriage continues to move downward. Accordingly, the pressure rod moves upward with respect to the sealing head carriage 28 thereby carrying the clamping pad 58 upward with respect to the sealing head carriage. Since the load cell bridge 56 is fixedly secured to the sealing head carriage 28 and the load cell 34 is located between the load cell bridge 56 and the clamping pad 58, the relative movement between the pressure rod and the sealing head carriage causes deformation of the load cell bridge. The amount of deformation of the load cell bridge is measured by the load cell, which provides a signal indicative of the force applied to the associated electronics of the apparatus 20. That electronics monitors the load cell signal and when the desired force/pressure, e.g., 40 pounds of top pressure, is achieved, the electronics provides a control signal to the sealing head carriage actuator servo motor 66 to cause it to stop moving the sealing head carriage 28 downward. At the same time the apparatus' electronics provides a control signal to the cam actuator servo motor 54 to initiate its operation, whereupon that motor causes the cam actuator 52 to drive the cam actuator plate 48 downward thereby moving the cam plate 48A of the cam assembly 44 downward. This action causes the cams 50 to engage portions of the roller assembly 42 to move the spring biased sealing rollers 32 radially inward towards central longitudinal axis 30 so that the rollers engage peripheral portions of the ferrule of the cap assembly. At the same time the apparatus' electronics provides a control signal to the motor 60 to cause it to operate. The operation of the motor 60 causes a drive belt 62, which is in engagement with the roller assembly 42, to begin to rotate thereby rotating the body 46 and the spring-biased rollers 32 located therein about the axis central longitudinal 30. Since the axis 30 of the sealing head is coaxial with the central longitudinal axis of the vial 10, the rotation of the roller assembly 42 about the axis 30 causes the rollers 32 to roll along the periphery of the ferrule immediately below the vial's flange. This action permanently crimps and deforms the ferrule into place, thereby completing the capping and sealing of the vial.

It should be pointed out at this juncture that the exemplary embodiment of the apparatus shown and described herein is merely one of many apparatus that can be constructed in accordance with the teachings of this invention. Thus, while the exemplary apparatus is shown wherein the platen is movable and the base stationary, apparatus can be constructed in accordance with this invention wherein the platen is stationary and the base movable. In fact, both the platen and base may be movable. What is important is that a load cell be used to determine when the desired amount of force/pressure has been applied to the cap assembly to produce a viable seal. In this regard, as should be appreciated by those skilled in the art from the foregoing, the usage of a load cell to determine when the desired amount of force/pressure has been applied to the cap assembly to seal it in place offers a considerable advantage over the prior art where compression of the elastomeric element is mechanical and dimensionally driven. In the prior art, the vial is raised a certain distance into a pressure block or platen. Thus, using that prior art technique, variations of vial height within the tolerance range of the vial manufacture influence the amount compression achieved.

In contradistinction, the use of a load cell of the subject invention to measure the amount of force that is applied to the cap assembly (e.g., the vial/stopper/ferrule combination) eliminates variations in the amount of force applied when vials are of varying tolerances. Moreover, the load cell and associated circuitry of this invention not only records force/pressure but also determines when the rollers are to begin to function to seal the cap in place. In particular, when a predetermined force is achieved the travel of the sealing mechanism downward is stopped and the roller(s) are triggered to complete the sealing operation. Thus, by using the apparatus/technique of the subject invention the variation in height of the vials is eliminated. Vials can vary as much as the limitation of travel of the sealing mechanism and still be perfectly sealed.

Without further elaboration the foregoing will so fully illustrate our invention that others may, by applying current or future knowledge, adopt the same for use under various conditions of service.

We claim:

1. Apparatus for capping and sealing a vial with a cap, the vial comprising a hollow body having an opening to the interior thereof and a flanged neck surrounding the opening, the flanged neck having an undersurface, the cap comprising an elastomeric stopper arranged for disposition within the opening in the vial and an annular seal arranged to be crimped around and tightly engage the flanged neck of the vial to hold the stopper in place, said apparatus comprising a base and a carriage, said carriage comprising a first member, a second member, a shaft, a platen, a load cell and at least one roller, said platen being secured to said shaft, said first member being secured to said shaft, said shaft being movable with respect to said carriage, said second member being fixed with respect to said carriage, said load cell being mounted between said first member and said second member, said base being arranged to receive the vial thereon with the vial oriented so that the neck of the vial confronts said platen, at least one of said base and said carriage being arranged to be move with respect to each other whereupon said platen is moved towards said base after the stopper is located in the opening of the vial to cause said platen to engage and apply a force to the stopper to drive the stopper into the opening of the vial, whereupon said load cell is squeezed between said first member and said second member to provide a signal indicative of the force applied to the stopper, said apparatus being arranged to halt the relative movement between said platen and said base when said signal provided by said load cell indicates the application of a desired force to the cap to thereby firmly seat the stopper within the opening in the vial and to cause said at least one roller to apply a force to the annular seal to crimp the annular seal on the neck of the vial to hold the stopper in place within the opening in the vial and thereby seal the vial.

2. The apparatus of claim 1 wherein said first member comprises a plate that is arranged to be adjustably secured to said shaft.

3. The apparatus of claim 2 wherein said shaft comprises at threaded member and wherein said first member is threadedly secured to said shaft.

4. The apparatus of claim 1 wherein said carriage is movable and is arranged to be moved toward and away from said base.

5. The apparatus of claim 1 wherein said base is movable and arranged to be moved toward and away from said platen.

6. The apparatus of claim 4 wherein said base is movable and arranged to be moved toward and away from said platen.

7. A method for capping and sealing a vial with a cap, said vial comprising a hollow body having an opening to the interior thereof and a flanged neck surrounding the opening, the flanged neck having an undersurface, said cap comprising an elastomeric stopper and an annular seal arranged to be crimped around and tightly engage said flanged neck of said vial to hold said stopper in place, said method comprising:

disposing said vial on a base and under a platen so that the neck of said vial confronts said platen, said platen forming a portion of a carriage, said carriage additionally comprising a first member, a second member, a shaft, a load cell and at least one roller, said platen being secured to said shaft, said first member being secured to said shaft, said shaft being movable with respect to said carriage, said second member being fixed with respect to said carriage, said load cell being mounted between said first member and said second member;

disposing a stopper in said opening in said vial and disposing an annular seal about said stopper and said neck of said vial;

moving at least one of said base and said carriage with respect to each other so that said platen applies a force to said stopper to drive said stopper into said opening, whereupon said load cell is squeezed between said first member and said second member to provide a signal indicative of the force applied to the stopper;

halting the relative movement of said carriage with respect to said base when said load indicates that a desired amount of force has been applied to said stopper to cause said stopper to be firmly seated within said opening in said vial; and utilizing said at least one roller to apply a force to said annular seal to crimp said annular seal on said neck of said vial to hold said stopper in place within said opening in said vial and thereby seal said vial.

8. The method of claim 7 wherein said base is movable and is moved toward said platen to apply the desired amount of force to said stopper.

9. The method of claim 7 wherein said carriage is movable and is moved toward said base to apply the desired amount of force to said stopper.

10. The method of claim 7 wherein both said carriage and said base are movable and are moved toward each other to apply the desired amount of force to said stopper.

* * * * *